US006213229B1

(12) United States Patent
Majkovic

(10) Patent No.: US 6,213,229 B1
(45) Date of Patent: Apr. 10, 2001

(54) DRILLING MOTOR DRILL BIT REAMING STABILIZER

(75) Inventor: Davor Majkovic, Edmonton (CA)

(73) Assignee: Smith International Canada Limited (CA)

( * ) Notice: Subject to any disclaimer, the term of this patent is extended or adjusted under 35 U.S.C. 154(b) by 0 days.

(21) Appl. No.: 09/286,658

(22) Filed: Oct. 13, 1998

(51) Int. Cl.[7] ..... E21B 17/10
(52) U.S. Cl. ..... 175/325.2; 175/325.5
(58) Field of Search ..... 175/61, 323, 325.3, 175/325.1, 325.2, 325.5

(56) References Cited

U.S. PATENT DOCUMENTS 3,825,083 * 7/1974 Flarity et al. ..... 175/394
3,978,933 * 9/1976 Olson et al. ..... 175/325
4,385,669 * 5/1983 Knutsen ..... 175/323
4,473,125 * 9/1984 Addudle et al. ..... 175/410
4,610,316 * 9/1986 Boaz ..... 175/323
4,667,751 * 5/1987 Geczy et al. ..... 175/61
4,862,974 * 9/1989 Warrren et al. ..... 175/61
5,474,143 * 12/1995 Majkovic ..... 175/323

* cited by examiner

*Primary Examiner*—Frank Tsay
(74) *Attorney, Agent, or Firm*—Townsend and Townsend and Crew LLP

(57) ABSTRACT

In one embodiment, the invention provides a drilling assembly comprising a motor, a reaming stabilizer and a drill bit. The motor is adapted to be attached to a drill string, the motor includes a drive shaft with a mandrel mounted at the bottom end of the shaft. The reaming stabilizer is attached to the shaft of the motor by the mandrel, so that the stabilizer may be rotatably driven by the motor. The drill bit is attached to the stabilizer to be rotatably driven by the stabilizer. The stabilizer is sized so that the overall length of the drilling assembly is increased by a maximum of about 16 inches. Greater lengths may reduce motor bearing life, adversely affect the steering of the tool or result in drive shaft breakage with consequent loss of the drill bit and stabilizer in the hole.

34 Claims, 1 Drawing Sheet

DRILLING MOTOR DRILL BIT REAMING STABILIZER

FIELD OF THE INVENTION

The invention is in the field of rotatable well drilling tools, and provides a well bore reamer and drill bit stabilizer for use in well drilling, particularly drilling using motor assemblies such as mud motors. The invention also provides methods for using the such a device in well drilling.

BACKGROUND OF THE INVENTION

Conventional well drilling technologies, particularly for drilling oil wells, involve the use of a rotatable drill bit fastened to the end of a drill string. The bit is attached to the string by a threaded pin (or dome) on the bit that is received in a threaded 'bit box' at the end of the string. The entire drill string, typically made up of a large number of threadably connected lengths of drill pipe, is rotated at the derrick to turn the bit in the hole. A wide variety of bits have been developed for use in different geological formations, such as the rock bits available from Smith International of Houston, Tex., USA.

A variety of drilling tools have been developed for attachment between the drill string and the bit to stabilize the bit in conventional straight-line drilling. U.S. Pat. No. 5,474,143 issued Dec. 12, 1995 to Smith International discloses a reaming drill bit stabilizer adapted for use in conventional drilling, in which the drill string is rotated to turn the bit. As disclosed therein, that reaming stabilizer is particularly suited to ensuring that the drill bit is stabilized and drills in a substantially straight line. In some circumstances, however, it is desirable to drill a well that deviates from a straight line.

Mud motors are particularly suited to directional drilling, in which the well bore is deliberately made to deviate from a straight line. In some formations, for example, it is desirable to drill horizontal wells, or a number of horizontal wells that are generally parallel to one another. Mud motors are typically capable of directional drilling because the motor is not straight. An example of such a motor is shown in U.S. Pat. No. 4,667,751 issued May 26, 1987 to Smith International. The bend in the mud motor may be oriented towards any wall of the well bore by turning the drill string. Once the motor is appropriately oriented, the motor may be operated to turn the bit, sliding the string forward as the well is excavated. The housing of the mud motor may be protected by stabilizers (which may be known as concentric stabilizers) which are not rotated by the motor, but may rotate with the whole motor for example when the motor is being oriented (see for example U.S. Pat. No. 4,667,751 issued to Smith International May 26, 1987). Concentric stabilizers are available, for example, for use with the DYNA-DRILL™ brand motors available from Smith International. Such stabilizers are typically slightly under-gage (smaller in diameter than the bit), since they serve to protect and in some cases to orient the motor.

Bits designed for drilling are generally not suited to reaming out a previously drilled bore. If they are to be used for reaming, such bits should generally be operated with reduced weight on the bit and at relatively low rpm., which may raise the cost and reduce the efficiency of drilling.

SUMMARY OF THE INVENTION

The invention provides a reaming stabilizer for use with a drilling motor. In one embodiment the stabilizer is made up as part of a drilling assembly comprising a motor, a reaming stabilizer and a drill bit. The motor is adapted to be attached to a drill string, the motor includes a drive shaft with a mandrel mounted at the bottom end of the shaft. The reaming stabilizer is attached to the shaft of the motor by the mandrel, so that the stabilizer may be rotatably driven by the motor. The drill bit is attached to the stabilizer to be rotatably driven by the stabilizer. The stabilizer is sized so that the overall length of the drilling assembly is increased by a maximum of about 16 inches. Greater lengths may reduce motor bearing life, adversely affect the steering of the tool or result in drive shaft breakage with consequent loss of the drill bit and stabilizer in the hole.

DETAILED DESCRIPTION OF THE INVENTION

Figure 1:
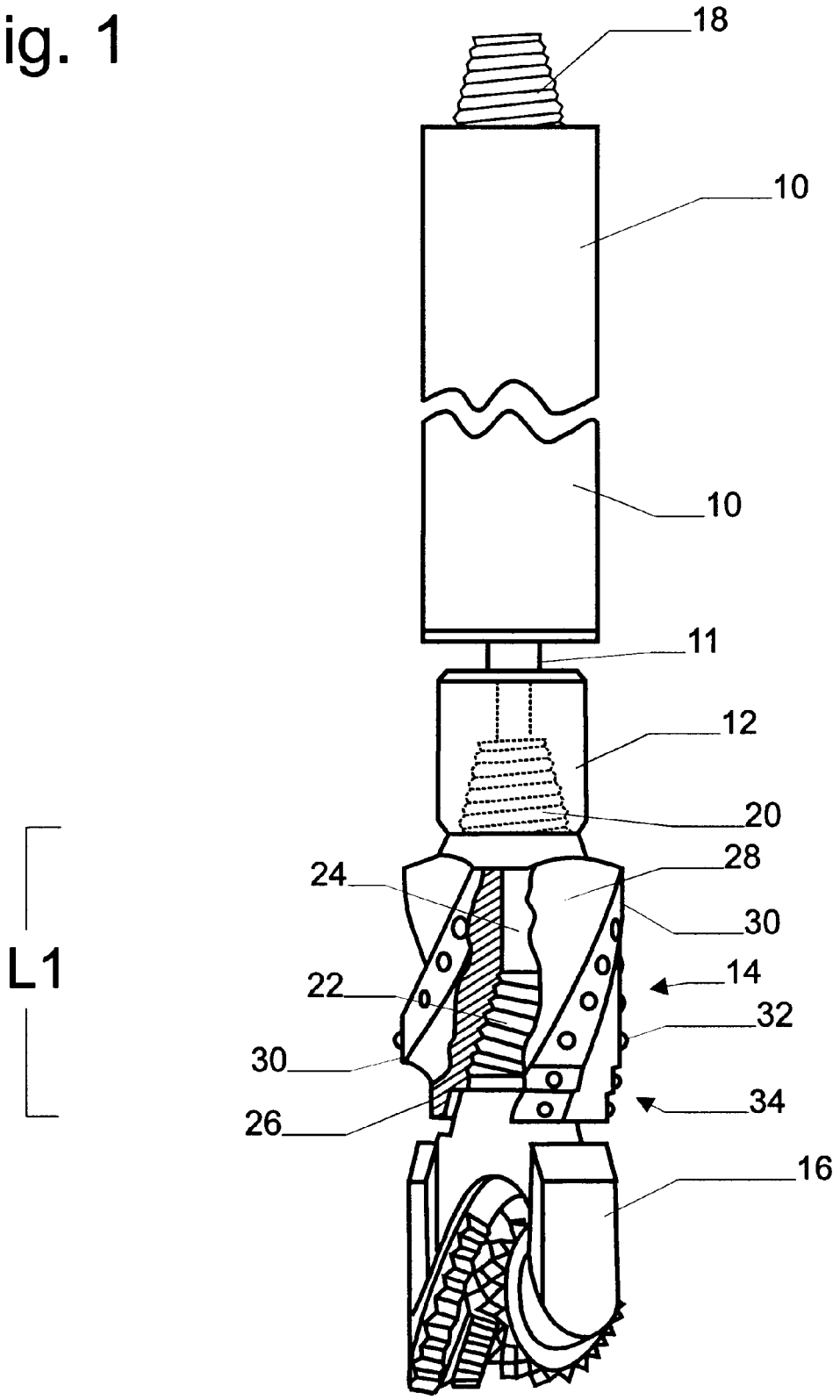
FIG. 1 is an elevational partially sectioned view of a drilling assembly of the invention, showing a motor attached to a reaming stabilizer which is in turn attached to a drill bit.

Referring to FIG. 1, the invention provides a drilling assembly comprising a motor 10 with a mandrel 12, a reaming stabilizer 14 and a drill bit 16. The downhole drilling motor 10 has a top end and a bottom end. The top end of the motor is adapted for connection to a drill string, typically by being provided with a conical threaded connector 18 at its top end. The motor 10 may be any of a wide variety of motor types, such as directional motors, straight-hole motors or steerable motors. Such motors 10 have a rotatable longitudinal drive shaft 11. The drive shaft 11 is connected to a longitudinal cylindrical mandrel 12 on the bottom end of the motor 10. The distal end of the mandrel 12 (in operation, the end furthest from the dill string) has an axial, internally threaded mandrel box 20. The box 20 is typically where a drill bit 16 would be attached to the motor 10, and may accordingly be referred to as the 'bit box'. The whole motor 10 is typically adapted to permit drilling fluid to flow through the motor 10, to drive it and to provide drilling fluid to the bit 16.

The invention provides a longitudinal, cylindrical, reaming stabilizer 14 with a top end adapted to be threadably connected to the mandrel box 20. The stabilizer 14 has longitudinal flutes 28 and lands 30. The flutes 28 are adapted to allow fluid flow back past the stabilizer 14 (for this reason the flutes 28 may be referred to as 'junk slots'). The lands 30 define the outer transverse stabilizer 14 diameter. The lands 30 and flutes 28 may be spirally arranged. In one embodiment, there are 6 lands 30 and 6 flutes 28.

The diameter of the stabilizer 14 is typically greater than the diameter of the mandrel 12, so that the stabilizer 14 protects the mandrel 12 from wear. The bottom end of the stabilizer 14 has an axial, internally threaded stabilizer box 22, for attachment of the drill bit 16. The stabilizer 14 is typically provided with an axial channel 24 to permit drilling fluid to flow through the stabilizer 14 into the drill bit 16.

The drill bit 16 is threadably received in the stabilizer box 22. Preferably, the stabilizer box 22 is provided with shoulders 26 that extend the lands 30 towards the bit 16, which may enhance the bit stabilizing effect of the stabilizer 14, improving bit performance and life. The transverse diameter of the drill bit 16 is substantially the same as the transverse diameter of the stabilizer 14. Accordingly, when the drill bit 16 wears down so that it goes under size, the stabilizer 14 will engage the hole and function as a reamer.

The stabilizer 14 is sized so that the drill bit 16 is longitudinally spaced apart from the distal end of the mandrel 12 by the stabilizer 14 by no more than about 16 inches, a distance shown as L1 in FIG. 1, or in alternative embodiments 10 inches, or 8 inches, and preferably from 5 to 8 inches. Preferably the stabilizer 14 is long enough to accept a 'sub breaker' tool that is adapted to accept the tongs typically used for assembly of the drill string components.

The lands 30 on the stabilizer 14 may be provided with a plurality of hardened inserts 32 extending outwardly from the lands 30. In which case, the outer edges of the inserts 32 will define the transverse diameter of the stabilizer 14. The hardened inserts 32 may be made with a hardened surface, such as a polycrystaline diamond or tungsten carbide. Preferably, the inserts 32 extend outwardly from the lands 30, defining between them spaces for material to flow past the inserts 32, which may help to reduce the torque added to the motor 10 once the stabilizer 14 begins to engage the hole in a reaming action. Preferably, the inserts 32 project from the lands 30 by between about ¼ inch and about ¾ inch, and the inserts 32 have a hemispherical conformation, these characteristics may help to ensure that the stabilizer 14 does not 'bite' into the hole too aggressively, which could cause an undesirable amount of torque and could also deform the well bore in an undesirable manner. The hardened inserts 32 may be removably mounted in the stabilizer 14 by brazing, for example by silver brazing the inserts 32 into a hole is about 4 to 5 thousandths of an inch oversize for the inserts 32. Such inserts 32 may be removed by melting the brazing to facilitate re-use of the tool. Alternatively, the inserts 32 may be tight fit in the stabilizer 14 in holes that are 3 to 4 thousandths of an inch under size hole.

The lands 30 may be provided with steps 34. In one embodiment, the steps 34 positioned towards the bottom end of stabilizer 14 extend outwardly from stabilizer 14 less than steps 34 positioned towards the top end of stabilizer 14. Hardened inserts 32 of the type discussed above may be mounted on the steps.

The use of the drilling tool of the invention provides an unexpected advantage, particularly when used in conjunction with rotatable cone bits operated with mud motors. When the drill bit 16 wears to a diameter less than the diameter of the reamer-stabilizer 14 tool of the invention, the hardened inserts 32 on the external surface of the reamer-stabilizer 14 will begin to engage the well bore, reaming the bore to maintain well gage. As the reamer-stabilizer 14 engages the well bore, the torque required to drive the bit 16 and the reamer-stabilizer 14 will generally begin to rise. When the bit 16 is being driven by a mud motor 10, this requirement for more torque to drive the bit 16 may be perceived by the driller as an increase in the pressure of the drilling fluid required to drive the motor 10. This requirement for increased torque provides the driller with an indication that the bit 16 has gone under-gage. At an appropriate point following this indication, the driller may then withdraw the string to replace the bit 16, to avoid prolonged uneconomical drilling with a worn bit 16 and reduce the risk of bit failure. In many cases the reamer-stabilizer 14 will not be worn down as quickly as the bit 16, so that the reamer-stabilizer 14 of the invention may be reused with a succession of bits.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way.

What is claimed is:

1. A drilling assembly comprising:

a downhole drilling motor having a top end and a bottom end, the top end being adapted for connection to a drill string, the motor having a rotatable longitudinal driven shaft connected to a longitudinal cylindrical mandrel on the bottom end of the motor, the mandrel having a transverse diameter and a distal end opposite the shaft, the distal end of the mandrel having an axial internally threaded mandrel box;

a longitudinal cylindrical reaming stabilizer having a top end and a bottom end, the top end of the stabilizer being threadably connected to the internally threaded mandrel box, the stabilizer having longitudinal flutes and lands, the lands defining a transverse stabilizer diameter greater than the transverse diameter of the mandrel, the bottom end of the stabilizer having an axial internally threaded stabilizer box;

a drill bit threadably received in the stabilizer box, the drill bit having a transverse diameter substantially the same as the transverse diameter of the stabilizer;

wherein the stabilizer is sized so that the drill bit is longitudinally spaced apart from the distal end of the mandrel by the stabilizer by no more than about 16 inches.

2. The drilling assembly of claim 1 wherein the stabilizer is sized so that the drill bit is longitudinally spaced apart from the distal end of the mandrel by the stabilizer by no more than about 10 inches.

3. The drilling assembly of claim 1 wherein the stabilizer is sized so that the drill bit is longitudinally spaced apart from the distal end of the mandrel by the stabilizer by no more than about 8 inches.

4. The drilling assembly of claim 1 wherein the lands are provided with a plurality of hardened inserts extending outwardly from the lands to define the transverse diameter of the stabilizer.

5. The drilling assembly of claim 2 wherein the lands are provided with a plurality of hardened inserts extending outwardly from the lands to define the transverse diameter of the stabilizer.

6. The drilling assembly of claim 3 wherein the lands are provided with a plurality of hardened inserts extending outwardly from the lands to define the transverse diameter of the stabilizer.

7. The drilling assembly of claim 4 wherein the hardened inserts comprise a polycrystaline diamond coating.

8. The drilling assembly of claim 5 wherein the hardened inserts comprise a polycrystaline diamond coating.

9. The drilling assembly of claim 6 wherein the hardened inserts comprise a polycrystaline diamond coating.

10. The drilling assembly of claim 4 wherein the inserts extend outwardly from the lands by no more than about 5/16 inch, and the inserts have a hemispherical conformation.

11. The drilling assembly of claim 9 wherein the inserts extend outwardly from the lands by no more than about 5/16 inch, and the inserts have a hemispherical conformation.

12. The drilling assembly of claim 4 wherein the hardened inserts are removably mounted in the stabilizer by brazing.

13. The drilling assembly of claim 9 wherein the hardened inserts are removably mounted in the stabilizer by brazing.

14. The drilling assembly of claim 11 wherein the hardened inserts are removably mounted in the stabilizer by brazing.

15. The drilling assembly of claim 1 wherein the lands comprise steps, steps towards the bottom end of the stabilizer extending outwardly from the stabilizer less than steps towards the top end of the stabilizer.

16. The drilling assembly of claim 3 wherein the lands comprise steps, steps towards the bottom end of the stabilizer extending outwardly from the stabilizer less than steps towards the top end of the stabilizer.

17. The drilling assembly of claim 4 wherein the lands comprise steps, steps towards the bottom end of the stabilizer extending outwardly from the stabilizer less than steps towards the top end of the stabilizer, wherein hardened inserts are mounted on the steps.

18. The drilling assembly of claim 6 wherein the lands comprise steps, steps towards the bottom end of the stabilizer extending outwardly from the stabilizer less than steps towards the top end of the stabilizer, wherein hardened inserts are mounted on the steps.

19. The drilling assembly of claim 9 wherein the lands comprise steps, steps towards the bottom end of the stabilizer extending outwardly from the stabilizer less than steps towards the top end of the stabilizer, wherein hardened inserts are mounted on the steps.

20. The drilling assembly of claim 14 wherein the lands comprise steps, steps towards the bottom end of the stabilizer extending outwardly from the stabilizer less than steps towards the top end of the stabilizer, wherein hardened inserts are mounted on the steps.

21. The drilling assembly of claim 1 wherein the lands and flutes are spirally arranged.

22. The drilling assembly of claim 20 wherein the lands and flutes are spirally arranged.

23. The drilling assembly of claim 1 wherein the motor, the stabilizer and the drill bit are provided with internal channels to permit a drilling fluid to flow from the drilling string to the bit.

24. A longitudinal cylindrical reaming stabilizer to be connected at one end to a motor mandrel box and threadedly connected to a drill bit at an opposite end, wherein the stabilizer is sized so that the drill bit is longitudinally spaced apart from the distal end of the mandrel by the stabilizer by no more than about 16 inches.

25. The longitudinal cylindrical reaming stabilizer of claim 24, wherein the stabilizer is sized so that the drill bit is longitudinally spaced apart from the distal end of the mandrel by no more than about 10 inches.

26. The longitudinal cylindrical reaming stabilizer of claim 24, wherein the stabilizer is sized so that the drill bit is longitudinally spaced apart from the distal end of the mandrel by the stabilizer by no more than about 8 inches.

27. The longitudinal cylindrical reaming stabilizer of claim 24, wherein the stabilizer has longitudinal flutes and lands, the lands defining a transverse stabilizer diameter greater than the transverse diameter of the mandrel.

28. The longitudinal cylindrical reaming stabilizer of claim 27, wherein the lands are provided with a plurality of hardened inserts extending outwardly from the lands to define the transverse diameter of the stabilizer.

29. The longitudinal cylindrical reaming stabilizer of claim 28, wherein the hardened inserts comprise a polycrystaline diamond coating.

30. The longitudinal cylindrical reaming stabilizer of claim 29, wherein the inserts extend outwardly from the lands by no more than about 5/16 inch, and the inserts have a hemispherical conformation.

31. The longitudinal cylindrical reaming stabilizer of claim 30, wherein the hardened inserts are removably mounted in the stabilizer by brazing.

32. The longitudinal cylindrical reaming stabilizer of claim 31, wherein the lands comprise steps, steps towards the bottom end of the stabilizer extending outwardly from the stabilizer less than steps towards the top end of the stabilizer, wherein the hardened inserts are mounted on the steps.

33. The longitudinal cylindrical reaming stabilizer of claim 32, wherein the lands and flutes are spirally arranged.

34. The longitudinal cylindrical reaming stabilizer of claim 33, wherein the stabilizer is provided with internal channels to permit drilling fluid to flow through the stabilizer.

* * * * *